United States Patent [19]

Perez et al.

[11] Patent Number: 4,818,456

[45] Date of Patent: Apr. 4, 1989

[54] SIMPLIFIED PROCESS FOR OBTAINING POLYESTER YARNS AT HIGH SPEED

[75] Inventors: Gerard Perez; Rene Vieilly, both of Lyon, France

[73] Assignee: Rhone-Poulenc Fibres, Lyon, France

[21] Appl. No.: 88,536

[22] Filed: Aug. 20, 1987

Related U.S. Application Data

[63] Continuation of Ser. No. 786,356, Oct. 11, 1985, abandoned, which is a continuation of Ser. No. 580,265, Feb. 15, 1984, abandoned.

[30] Foreign Application Priority Data

Feb. 16, 1983 [FR] France ..... 83 02628

[51] Int. Cl.[4] ..... D01F 6/62; D01D 5/088; D01D 5/12

[52] U.S. Cl. ..... 264/103; 264/211.14; 264/210.2; 264/210.8; 264/290.5; 264/290.7; 264/130

[58] Field of Search ..... 264/103, 290.7, 211.14, 264/210.2, 210.8, 290.5, 130

[56] References Cited

U.S. PATENT DOCUMENTS 2,604,667 7/1952 Hebeler ..... 264/210.8
3,996,324 12/1976 Landenbager et al. ..... 264/103
4,049,763 9/1977 Mineo et al. ..... 264/210.8
4,237,187 12/1980 Razbon, Jr. et al. ..... 264/103

FOREIGN PATENT DOCUMENTS 2615246 10/1977 Fed. Rep. of Germany .
2277913 7/1975 France .
0012327 1/1977 Japan ..... 264/103

*Primary Examiner*—Jan H. Silbaugh
*Assistant Examiner*—Hubert C. Lorin
*Attorney, Agent, or Firm*—Stevens, Davis, Miller & Mosher

[57] ABSTRACT

The invention provides a process for simplified spinning of yarns on polyethylene terephthalate, at high speed and with direct take-up on the winder. After leaving the spinning die, the filaments are cooled by a gaseous fluid, simultaneously brought together and oiled at a convergence point situated at a distance $L_1$ from the die such that $L_o \leqq L_1 \leqq (L_o+30)$cm, the value of $L_o$ corresponding to the first point at which the derivative of the curve expressing the birefringence of the filaments as a function of the distance (in cm) from the die passes through a maximum, and wound at a speed greater than 4,500 m/min, preferably equal to or greater than 5,000 m/min, the maximum distance between the die and the point of deposition of the yarn on the bobbin being between 100 and 200 cm. The yarns obtained may be used as such or may be textured.

5 Claims, 1 Drawing Sheet

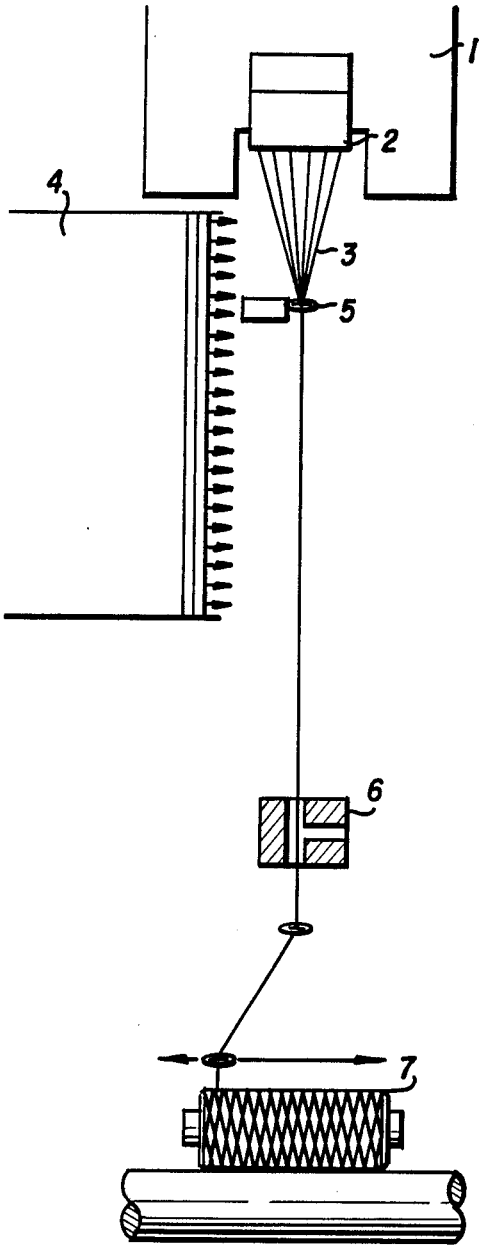
1
2
3
4
5
6
7

SIMPLIFIED PROCESS FOR OBTAINING POLYESTER YARNS AT HIGH SPEED

This application is a continuation of application Ser. No. 786,356, filed Oct. 11, 1985, now abandoned, which in turn is a continuation of application Ser. No. 580,265, filed Feb. 15, 1984, now abandoned.

The present invention relates to obtaining polyester-based filaments at high speed, according to a simplified and "compact" process.

More particularly, the invention relates to obtaining oriented yarns with low shrinkage directly by spinning.

It has long been known from U.S. Pat. No. 2,604,667 that it is possible to obtain polyester yarns which can be used directly in textile applications, by extrusion of the polymer into an atmosphere at ambient temperature followed by winding at speeds above 4,755 m/min, the filaments having to cover a distance of at least 114–127 cm to be completely solidified, because at distances of 76–100 cm build-ups of molten fibres form on the technical parts with which they come into contact.

However, it has not been possible to make use of this process during the years following the publication of this patent because the technology of the devices for winding the yarns was not available, this type of equipment having been perfected only recently.

With the improvement of these devices permitting increasingly higher winding speeds to be reached, adaptations and modifications of the process described in U.S. Pat. No. 2,604,667 have been produced.

In fact, in high-speed spinning, the tension which is imposed on the yarns by friction in the cooling atmosphere increases significantly with the speed until it reaches levels which are incompatible with production of acceptable bobbins by direct winding.

Various solutions have been proposed to reduce the tension and avoid the use of take-off rollers regulating the tension upstream of the winder.

Among these proposals, for example, is a cooling chamber closed at its base by a wall allowing only the filaments to pass (German Application No. 2,615,246), and false twist guides (U.S. Pat. No. 3,996,324); according to the article by H. LUCKERT and M. BUSCH, published in Chemiefasern/Textilindustrie (Volume 38/85—January 1983), the solutions proposed for reducing the tension consist either of a special yarn-guide system which is not described, or of a special process comprising an oiling cell where the filaments are converged and are oiled after the cooling cell.

It is also known, according to French Pat. No. 2,277,913, to spin synthetic polymers in particular of polyester and to wind them directly, at speeds of 2,500–5,000 m/min, the filaments being converged at a distance from the die which, in all the examples, is at least 1.25 meters, the total distance between the die and the reeler being about 4 meters. But although the declared aim of the patent is to reduce the tension, no numerical value is given and it is therefore impossible to assess the value of the process.

The present application provides a process permitting the spinning of yarns under more economical conditions.

The present invention provides more particularly a process for the simplified spinning of polyester-based filaments at high speed with a direct take-up of these filaments on the winder, which comprises, after spinning the filaments:

cooling the filaments after they have left the spinning die with a gaseous fluid, simultaneously bringing the filaments together and oiling them at a convergence point situated at a distance $l_1$ from the die such that $l_o \leqq l_1 \leqq (l_o+30)$ cm, the value of $l_o$ corresponding to the first point at which the derivative of the curve, expressing the birefringence $\Delta n$ of the filaments as a function of the distance (in cm) relative to the die, passes through a maximum, under the desired spinning conditions, and winding the filaments on a bobbin at a speed equal to or greater than 4,500 m/min, preferably equal to or greater than 5,000 m/min, the maximum distance between the die and the point of deposition of the filaments on the bobbin being between 100 and 200 cm.

One of the controlling factors of the process of the present invention is the position of the point of convergence of the filaments, where they are simultaneously oiled. This point is determined by the change in the birefringence of the filaments starting from the die under the required spinning conditions. The value of $l_o$ is determined by a suitable method, an example of which will be given later, $l_o$ being the maximum value determined over a very large number of measurements of the first point at which the derivative of the curve expressing the birefringence of the filaments as a function of the distance (in cm) relative to the die passes through a maximum. All other conditions being equal, $l_o$ decreases with increasing stress, so that $l_o$ decreases with increasing speed. The minimum distance $l_1$ is such that $l_o \leqq l_1$.

The upper limit of $l_1$ is $l_o+30$ cm, preferably $l_o+10$ cm. Beyond this value, a rapid increase is observed in the yarn tension which does not permit acceptable winding; and below the lower limit $l_o$ sticking of the filaments is observed, which makes spinning impossible, bearing in mind the other parameters of the process, in particular the recommended speeds, the overall height between the die and the point of deposition of the yarn on the reel, and the like.

After converging, the filaments can also be interlaced to impart good cohesion to the yarns and to facilitate their use in certain applications.

The process according to the present invention applies especially to the spinning of polyethylene terephthalate and copolyesters containing at least 80% of ethylene terephthalate units with the addition of up to 20% of other units, for example with ethylene glycol being replaced by another diol such as butanediol, hexanediol, and the like, or with the terephthalic acid starting material being replaced by another acid such as isophthalic, hexahydroterephthalic, diphenic, or a similar acid.

The polyethylene terephthalate can, if appropriate, be modified with low molar quantities of a branching agent comprising 3 or 4 alcohol or acid functional groups such as trimethylolpropane, trimethylolethane, pentaerythritol, glycerol, trimesic acid, trimellitic acid, pyromellitic acid, and the like.

The original polyester can also contain known additives such as light stabilisers or heat stabilisers, additives intended to reduce static electricity or to modify dyeing affinity, matting agents, and the like.

The process according to the present invention will be understood better with the aid of FIG. 1, which shows diagrammatically an embodiment of the process comprising a heater 1 in which the polymer is melted before passing into the orifices of a die 2; the filaments 3 are then cooled by a gaseous medium which passes through the bundle of filaments and is emitted by a blower 4, and are brought together at a convergence point 5, being simultaneously oiled, and then interlaced by means of a nozzle 6 and wound on the winder 7.

Other alternative forms of embodiment can be employed without departing thereby from the process according to the present invention. In particular the filaments leaving the die may be immediately reheated over a short distance, less than 10 cm, preferably less than 7 or 5 cm, before being cooled by the gaseous fluid. The gaseous fluid can be air which may contain a more or less considerable amount of moisture.

The distance $l_1$, as defined above, depends on a number of factors such as the nature of the polymer spun, the viscosity of this polymer, the spinning speed, the count per filament, the cooling conditions, and the like.

In practice it is generally between 30 and 70 cm, preferably 40 to 60 cm.

Such a process is industrially particularly advantageous for the yarns with fine filaments.

The spinning speed employed throughout the text is also the speed of winding the yarns. For economic reasons it is greater than 4,500 m/min, preferably greater than 5,000 m/min, and can go up as far as 8,000 m/min or even higher. It depends essentially on technical components permitting the process to be carried out industrially. The maximum length from the die as far as the point of deposition of the yarn on the bobbin ranges between 100 and 200 cm. The overall height requirement of the device, that is to say including the winder, does not exceed 220 cm, in contrast to the description in the article in Chemiefasern/Textilindustrie (January 1983) in which the height of the die at the triangulation is already 2.20 meters.

Such a process can be carried out industrially in a single step (in contrast to the conventional processes), with the result that the operator has easy access both to the die and to the winder, which represents a major economic advantage from the point of view of processing, energy and handling.

The winder can in practice be easily placed as close as the level immediately below the convergence, the convergence/winder distance $l_2$ not being a critical value within the limits of the definition. The length $l_2$ depends only on the overall dimensions of the devices which may be provided between the convergence and the winder, for example an interlacing nozzle, and the height of triangulation. To reduce the overall dimensions of spinning machines, it is also possible to provide several dies mounted together in parallel, with several yarns converging at the same level and a number of winders offset vertically or horizontally relative to each other, the yarns then forming a small angle relative to the spinning axis, to be capable of being wound.

Compared to the processes known hitherto and to the conventional processes, the process according to the present invention offers the following advantages:

it comprises the same technical components in its working but in a clearly more limited volume, which naturally results in savings in investment, operation and manpower, it makes it possible to work at higher speeds without the need for use of a tension-regulating device such as intermediate rollers or sophisticated winders, which implies that the yarn has reached a tension which is not excessive, generally not greater than 2 cN/tex, and a sufficient stability at the time of its deposition on the bobbin, it permits, in appropriate cases, an easy interlacing by virtue of the low tension in the yarn after the convergence point.

The yarns produced in this way have mechanical properties and shrinkage properties which are close to those of yarns obtained at comparable speeds using the high-speed spinning processes employed industrially at the present time. Like the latter, the yarns according to the invention are very uniform (count, mechanical and shrinkage properties, dyeing affinity). Furthermore, they have good cleanness. They can be employed as such for producing woven articles (lining, protective clothing) and articles which are knitted, or subsequently textured according to any process employed industrially at the present time. They have, above all, a good uniformity of count and, in the case where they are interlaced, a level of cohesion which is suitable for their subsequent use.

In the examples which follow, the intrinsic viscosity of the polyester is determined at a concentration of 1% by weight per volume in ortho-chlorophenol at 25° C. and extrapolated to zero concentration. It is measured by means of an "Ostwald" type viscometer.

The values of tenacity, elongation and Young's modulus are determined by means of an apparatus known in commerce under the tradename INSTRON 1122 according to French Standard NF G 07-003.

The cohesion factor, measured with an apparatus known in commerce under the tradename "ROTSCHILD" (NPT—Type 2040), consists in detecting automatically the distance between points of interlacing by means of a needle which is placed between the filaments of a yarn in motion and which is retracted as soon as it encounters a point of resistance.

The cohesion factor is expressed by the ratio $$f=100/d$$

d being the average distance in cm between points of interlacing, calculated for at least 100 points.

The measurement of shrinkage in boiling water is carried out on a doubled yarn knotted at its end which is subjected to a standard pre-tension of 50 mg/dtex. The length $l_o$ of the doubled yarn is read at the level of the knot before treatment, on a graduated scale, then the yarn is immersed for 15 minutes in the free state in boiling water, then placed for 10 minutes in the free state in an oven at 80° C. and left for at least 60 minutes in the free state in a standard atmosphere (65% RH and 20° C.±2). The $L_1$ of the yarn is read.

$$BW \text{ shrinkage}=(L_o-L_1)/L_o\times 100$$

The measurement of the shrinkage under dry heat (dry air) is also carried out on a doubled yarn knotted at its end using the same pre-tension as above. The length $L_o$ is read.

Then the yarn is treated for 30 minutes in a ventilated oven at 160° C. and is left for at least 60 minutes in the free state in a standard atmosphere. The new length $L_1$ is read.

$$SA \text{ shrinkage } 160^\circ \text{ C.}=(L_o-L_1)/L_o\times 100$$

The measurement of shrinkage in saturated steam is carried out on a doubled yarn knotted at its end and under the same pre-tension of 50 mg/dtex. The length $L_o$ is read. Then the yarn is placed for 30 minutes in an oven containing steam at 130° C., then left for 10 minutes in the free state in an oven at 80° C. and finally for 60 minutes in the free state in a standard atmosphere. The length $L_1$ is then read.

Saturated steam shrinkage 130° C.$=(L_o-L_1)/L_o\times 100$

The mean linear non-uniformity U% expresses the mass variations along the controlled yarn. These mass variations are distributed on either side of the mean of the mass per unit length and are measured as a function of this mean, using an "USTER, type B-11" uniformity meter and an "USTER, type L-13" integrator which permits the value of the mean non-uniformity to be integrated as a percentage.

The distance $l_o$ is determined using the following method:

Under the required spinning conditions, but without taking into account the positions of the point of convergence and of the winder, samples of the bundle emerging from the die are taken by means of a device for simultaneous double cuts. The birefringence—which is a measure of the orientation of the polymer chain segments—is determined for the samples by means of a common microscope sold under the tradename LEITZ by measuring the difference between the principal indices of the fibres of a circular shape by means of an optical compensation method (BEREK compensator). For a yarn having a maximum of 30 filaments, all the filaments are sampled and examined as a function of the distance from the die, and for a yarn having more than 30 filaments, 20 filaments sampled at random during spinning are examined. By determining in this way the values of the birefringence as a function of the distance from the die, the distance $l_o$ is established. As indicated above, $l_o$ is the maximum value determined for a very large number of measurements of the first point at which the derivative of the curve expressing the birefringence of the filaments as a function of the distance (in cm) relative to the die passes through a maximum.

All the examples are obtained using a device of the same type as that in FIG. 1, that is to say with direct take-up of the yarn on the winder.

EXAMPLE 1

A polyethylene terephthalate matted with 0.5% by weight of titanium oxide, with an intrinsic viscosity of 0.58 and a dynamic viscosity in the molten state at 290° C. of 123 Pa s, is prepared. The polymer is melted in an extruder and conveyed to a die at a temperature of 293° C., then spun through the die which is maintained at 281° C., and has 33 orifices 0.23 mm in diameter.

The filaments which are taken up at 5,800 m/min are cooled transversely with air at a speed of 55 m/min and are then converged at a distance $l_1$ from the die of 36 cm and oiled simultaneously. The distance $l_1$ is equal to $l_o+5$ cm, the determination of $l_o$ by the above method giving a value of 31 cm for this parameter. The filaments pass over guide pins placed immediately under the point of convergence, are interlaced by means of a nozzle in which the pressure of compressed air is $4.10^5$ Pa, then wound directly at a distance of 177 cm from the die at the speed of 5,800 m/min.

The winding tension is 14–15 cN.

The winding obtained has good appearance, and the yarns have the followimg characteristics:

total count (dtex) per yarn 73.5
number of filaments per yarn 33
elongation (%) 44
tenacity (cN/tex) 32
U% 0.72
cohesion factor 23
boiling water shrinkage (%) 3.3
saturated steam shrinkage 130° C. (%) 3.4
dry air shrinkage 160° C. (%) 3.5
Young's modulus (cN/tex) 670

EXAMPLE 2 (COMPARATIVE)

A polymer which is identical to that employed in the preceding example is employed.

The polymer is melted and conveyed to a die at a temperature of 296° C., then spun through the die having 33 orifices 0.23 mm in diameter and maintained at a temperature of approximately 285° C.

The filaments taken off at a speed of 5,800 m/min are cooled by air discharged at 60 m/min, then converged and simultaneously oiled at a distance of 35 cm from the die ($l_o$ determined by the above method being equal to 31 cm). The filaments are then interlaced in a nozzle and wound at the speed of 5,800 m/min at a distance of 560 cm from the die. The winding tension is 29 cN and it is impossible to obtain an acceptable winding. We report that above 30 cN, even the removal of the bobbin becomes impossible.

EXAMPLE 3

A polyethylene terephthalate identical to that of Example 1 is employed, which is melted and which is conveyed to a die at a temperature of 296° C. and which is then spun through the die maintained at 288° C. and having 33 orifices 0.23 mm in diameter.

The filaments taken off at the speed of 5,800 m min are cooled with air discharged at a speed of 50 m/min, then converged and oiled at a distance of 48 cm from the die ($l_o$ determined by the above method being equal to 31 cm). They are then interlaced and wound at the speed of 5,800 m/min, the axis of the bobbin being at a distance of 177 cm from the die.

The winding tension recorded is 15 cN.

The winding, while remaining quite good, presents more difficulties due to a convergence position which is too low under the actual conditions of spinning.

The yarns obtained have the following properties:

count (dtex) 72
number of filaments 33
elongation % 38
tenacity (cN/tex) 27.6
U% 0.8
cohesion factor 21
boiling water shrinkage (%) 3.5
saturated steam shrinkage 130° C. (%) 3.6
dry air shrinkage 160° C. (%) 3.6
Young's modulus (cN/tex) 690

EXAMPLE 4 (COMPARATIVE)

A polyethylene terephthalate identical to that of Example 1 is melted and, after being heated to a temperature of 296° C., is conveyed to a die having 33 orifices 0.23 mm in diameter and maintained at 288° C., through which it is spun.

The filaments taken off at the speed of 5,800 m min are cooled with air blown transversely at a speed of 50 m/min, then converged and simultaneously oiled at a point situated at a distance of 90 cm from the die, a distance which is within the range of conventional processes. The filaments are then interlaced and wound on the winder at the speed of 5,800 m/min, the axis of the winding tube being situated at 177 cm from the die.

The winding tension is 28 cN for a count of 72 dtex; it is incompatible with an acceptable winding; in particular a hooping effect is produced on the tube.

The above examples demonstrate the benefits of the invention, in particular from the point of view of winding tension and the building up of windings, benefits which stem from the combination of two parameters: the distance between die and convergence and the distance between die and winder.

What is claimed is:

1. A process for high-speed spinning of polyester based filaments which comprises:

cooling filaments with a gaseous fluid after they have left a spinning die;

simultaneously bringing the filaments together and oiling them at a convergence point situated at a distance $L_1$ from the die such that $L_o \leqq L_1 \leqq (L_o+30)$ cm, the value of $L_o$ corresponding to the first point at which the derivative of a curve expressing the birefringence $\Delta n$ of the filaments as a function of the distance (in cm) relative to the die passes through a maximum, under the desired spinning conditions; and directly winding the filaments on a bobbin at a speed greater than 4,500 m/min and at a tension no greater than about 2 cN/tex, wherein the maximum distance between the die and the point of deposition of the yarn on the bobbin being 100 to 200 cm.

2. A process according to claim 1, in which the distance from the die to the convergence point is 30 to 70 cm.

3. A process according to claim 1 in which the speed of winding is equal to or greater than 5,000 m/min.

4. A process according to claim 1, in which the filaments are interlaced after the convergence point.

5. A process for high-speed spinning of polyester based filaments, which comprises:

cooling filaments with a gaseous fluid after they have left a spinning die;

simultaneously bringing the filaments together and oiling them at a convergence point situated at a distance of 40 to 60 cm from the die; and directly winding the filaments on a bobbin at a speed greater than 4500 m/min and at a tension no greater than about 2 cN/tex, wherein the maximum distance between the die and the point of deposition of the yarn on the bobbin being 100 to 200 cm.

* * * * *